US006945507B2

(12) United States Patent
Baarda et al.

(10) Patent No.: US 6,945,507 B2
(45) Date of Patent: Sep. 20, 2005

(54) GAS FLOW CONTROL

(75) Inventors: Gerrit Jan Baarda, Emmen (NL); Derk Vegter, Neuw-Amsterdam (NL)

(73) Assignee: Honeywell International, Inc., Morristown, NJ (US)

( * ) Notice: Subject to any disclaimer, the term of this patent is extended or adjusted under 35 U.S.C. 154(b) by 139 days.

(21) Appl. No.: 10/622,102

(22) Filed: Jul. 17, 2003

(65) Prior Publication Data

US 2004/0056221 A1 Mar. 25, 2004

(30) Foreign Application Priority Data

Jul. 18, 2002 (DE) ..... 102 32 653

(51) Int. Cl.[7] ..... F23N 1/00

(52) U.S. Cl. ..... 251/25; 251/30.02; 251/61.5; 137/100

(58) Field of Search ..... 251/25, 30.02, 251/61–61.5; 137/100

(56) References Cited

U.S. PATENT DOCUMENTS 3,741,710 A 6/1973 Nelson 4,615,354 A * 10/1986 Bianchi ..... 137/110

FOREIGN PATENT DOCUMENTS

| | | |
|---|---|---|
| DE | 21 11 343 | 4/1972 |
| DE | 198 21 853 C1 | 7/1999 |
| DE | 100 18 757 A1 | 10/2001 |
| DE | 100 26 035 A1 | 12/2001 |
| EP | 0 379 759 B1 | 4/1995 |
| EP | 1 058 060 A1 | 12/2000 |

* cited by examiner

*Primary Examiner*—J. Casimer Jacyna

(57) ABSTRACT

A gas flow controller includes a control valve coupled for actuating a main valve. In one example embodiment, a gas flow controller includes a main valve and a servo valve operated by an actuator, said servo valve being used for controlling the opening of the main valve. The servo valve is implemented in a variety of manners, such as a three-way valve means or as a double two-way valve. The servo valve further communicates, via gas pipes, with a first gas chamber limited by a diaphragm being in operative connection with the main valve, as well as to a second gas chamber in the inlet area, and a third gas chamber in the outlet area.

20 Claims, 2 Drawing Sheets

GAS FLOW CONTROL

FIELD OF THE INVENTION

The invention relates to gas flow control, and more specifically, to a gas flow controller.

BACKGROUND

Many types of gas flow controllers have been implemented for a variety of applications. For example, many known control arrangements for gas burners include a main valve, a servo valve and a servo controller, wherein the servo controller serves to control a gas output pressure by controlling the opening of the main valve.

For modulating the gas outlet pressure, an actuator is provided for the servo valve and achieves an opening and closing of the servo valve at the pertinent frequency, which can be modulated.

FIG. 2 shows one such gas flow controller to which various implementations of the present invention may be applicable. This controller comprises a main valve, the valve head 21 of which cooperates with a valve seat 22 and is loaded by a spring 30 into its closing position. The valve head 21 is connected to a diaphragm 23 above which a first gas chamber 24 is provided. The gas flows from the inlet 34 into the second gas chamber 25 and can flow on into the third gas chamber 31 when the main valve is open, and from there to the outlet 35. If the main valve is closed, a gas flow is prohibited. In the closing position, the two-way valve 29, which is operable electrically, is in its closed position. The two-way valve 29 is held in this position due to an appropriate pressure difference in the gas chambers 24, 25 acting on the diaphragm, and due to the force of the spring 30 acting on the valve seat 21. Thus, gas flows into the first gas pipe 27 through the second gas pipe 26 which has a certain resistance adapted, if necessary, to be influenced by a throttle 32, since a flow through the two-way valve 29 is not possible due to the closed position of the same.

If there is a pressure equalization between the first gas chamber 24 and the second gas chamber 25, the main valve is nevertheless securely held in its closed position, since it is loaded into the closed position by the pressure spring 30. If the two-way valve 29 is opened, gas flows via the first gas pipe 27 and the second gas pipe 26 through the two-way valve 29 into the third gas pipe 28 ending in the third gas chamber 31. The pipe portion upstream of the two-way valve 29 and through the two-way valve 29 shows a certain flow resistance that can, if necessary, be influenced by a throttle 33. Thus, gas flows out of the first gas chamber 24 until the gas pressures in the first gas chamber 24 and in the third gas chamber 31 are equal. Furthermore, no additional gas flows via the first and second gas pipes 27, 26 into the first gas chamber 24, as this rather flows via the two-way valve 29 into the third gas pipe and, thus, into the third gas chamber 31.

Accordingly, if the two-way valve 29 is shut again, i.e., if a flowing-off via the third gas pipe 28 into the third gas chamber 31 is impossible, there is another pressure equalization between the first gas chamber 24 and the second gas chamber 25, with the result that the main valve closes again. It is obvious that, for the mode of operation of this control means, the coordination of the pipe resistances is of major importance. Such control means must have a certain minimum closing speed. Thus, to allow an appropriately quick closing of the main valve, the pipe resistances have to be coordinated accordingly. Furthermore, a certain opening speed has to be ensured and, of course, a certain maximum opening of the main valve, ensuring the desired gas flow from the inlet 34 to the outlet 35. No pressure modulation by mere adjustment of a certain differential pressure between the first gas chamber 24 and the second gas chamber 25 is possible with this controller. The cross-sections and flow resistances of the gas pipes are coordinated such that the required and desired opening and closing speeds are reached. Thus, when the two-way valve 29 is opened, the main valve is automatically taken into its open position at a predetermined speed, whereas, when the two-way valve 29 is closed, a complete closing of the main valve sets in along with the desired closing speed. Thus, a pressure modulation is only possible if the servo two-way valve 29 is operated in a pulsed manner with the pulse width being modulatable.

SUMMARY

The present invention is directed to a control arrangement for gas flow that addresses challenges including those discussed above.

According to an example embodiment of the present invention, a gas flow controller comprises a main valve and a servo valve adapted for effecting differential pressure modulation therebetween without necessarily modulating the actuation frequency of the servo valve.

According to a more particular example embodiment of the present invention, a gas flow controller includes a three-way servo valve means connected via gas lines for selectively controlling differential pressure across a diaphragm for controlling a main valve. The three-way valve is connected to a first gas chamber that is substantially formed so as to be closed off, and via the pressure of which the main valve is operated. Furthermore, the three-way valve means is connected to a second gas chamber in the inlet area of the gas flow controller, and to a third gas chamber in the outlet area of the control valve. The diaphragm separates the first and second gas chambers and is responsive to differential pressures therebetween. The three-way valve means can be provided by a single three-way valve, or by a suitable combination of two-way valves.

In one implementation, the three-way valve means is adapted for switching such that either the first gas chamber is connected to the second gas chamber or the first gas chamber to the third gas chamber. Via such a connection, the main valve can be easily controlled, addressing challenges including those discussed above. Moreover, the opening cross-section of the main valve can be modulated for achieving the desired modulation of the gas flow by the gas flow controller.

The above-discussed arrangement can be implemented in a variety of manners. For instance, in one implementation, the main valve is put into its closed position by a suitable pressure difference between the gas chambers and, furthermore, by means of a spring. The main valve is then opened by negative pressure in the first gas chamber vis-à-vis the second gas chamber. For this, the main valve is in operative connection with a diaphragm dividing off the first gas chamber from the second gas chamber. The negative pressure in the first gas chamber facilitates the actuation of the diaphragm in a direction toward the fist chamber (and the lower pressure), thus moving the valve in the same (open) direction.

In another example embodiment of the present invention, opening and closing speeds of the main valve are selected to achieve a variety of results. To meet these, the cross sections and flow resistance in the gas pipes and through the three-way valve means are adjusted to the desired opening and closing speeds of the main valve. In a more particular implementation, the cross section and the flow resistance in the gas pipes, the three-way valve means, particularly in the gas pipe which connects the three-way valve means with the second gas chamber, and the corresponding inlet area of the three-way valve are adjusted for a modulation of the opening of the main valve. A modulation that is effective and well controllable is readily effected when the desired opening cross section of the main valve is reproducible and reliably adjustable. With the approaches discussed herein, such modulation is achieved, and the gas pipe for the pressure build-up in the first gas chamber can be designed in a completely independent manner from the gas pipe for pressure release in the first gas chamber.

BRIEF DESCRIPTION OF THE FIGURES

In the following, the invention will be described more precisely by referring to example embodiments in combination with the attached drawings wherein.

DETAILED DESCRIPTION

In the following description, reference is made to the accompanying drawings that form a part hereof, and in which is shown by way of illustration particular embodiments in which the invention may be practiced. It is to be understood that other embodiments may be utilized, as structural and operational changes may be made without departing from the scope of the present invention.

According to an example embodiment of the present invention, a gas flow controller includes a control valve arrangement coupled to gas chambers on opposite sides of a diaphragm and arranged for controlling a main valve as a function of differential pressure across the diaphragm. The control valve is coupled to an inlet and outlet of the gas flow controller, and to an auxiliary chamber limited by the diaphragm. The inlet and outlet are in a chamber separated by the main valve, and are coupled when the main valve is open. The control valve arrangement controls the differential pressure (between the inlet and the auxiliary chamber) by selectively coupling the inlet, outlet and auxiliary chambers.

Figure 1:
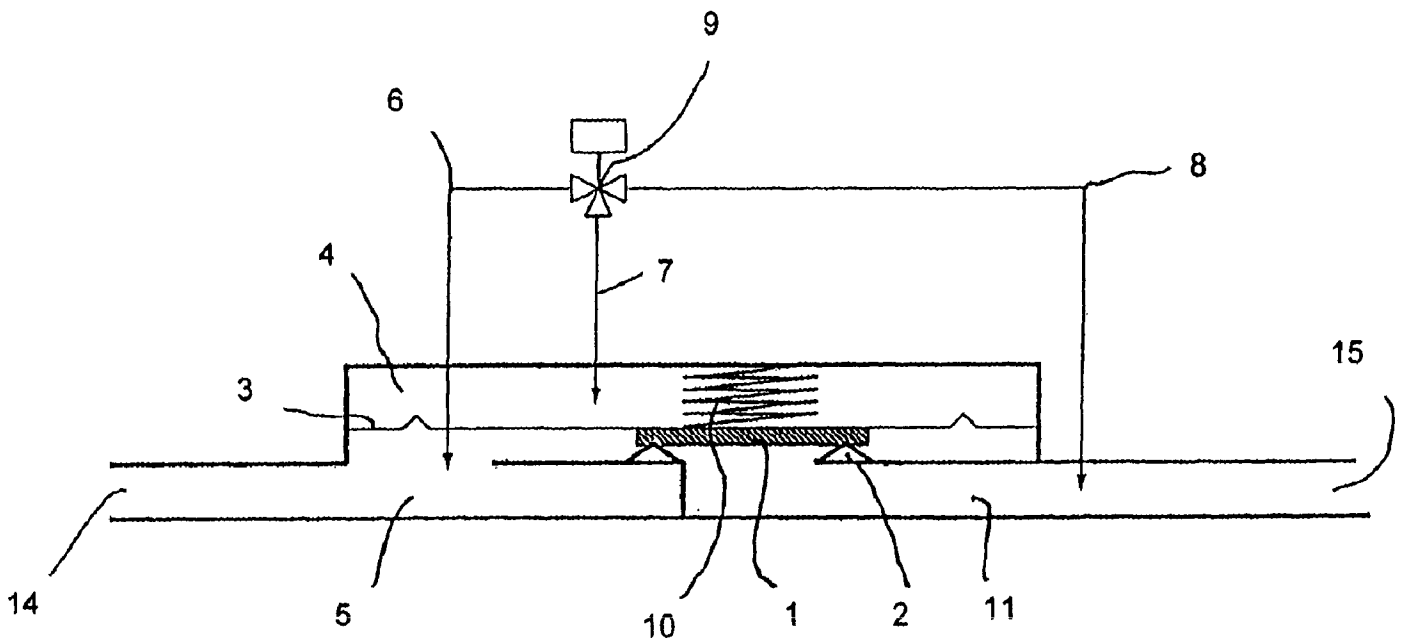
FIG. 1 shows a principle sketch of a gas flow controller, according to an example embodiment of the invention.
Figure 2:
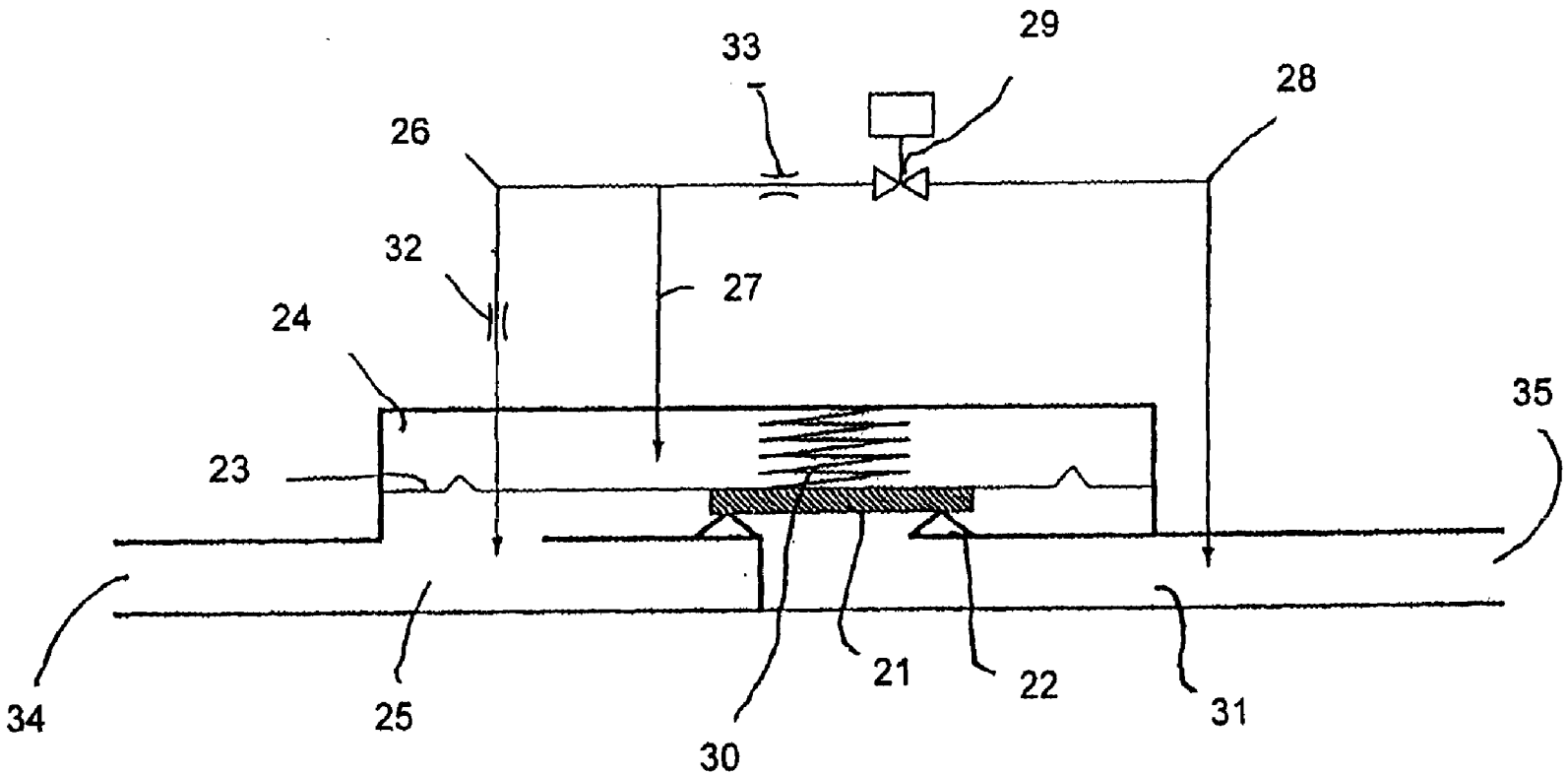
FIG. 2 shows a valve arrangement to which various example embodiments of the present invention are applicable.

FIG. 1 shows a gas flow controller, according to another example embodiment of the present invention. Gas flows from the inlet 14 to the second gas chamber 5. If the main valve is in the shown closed position, i.e., if the valve head 1 rests on the valve seat 2, the gas cannot flow on to the third gas chamber 11 and, thus, to the outlet 15. The gas flow is interrupted and the controller is locked. Thus, the valve head 1 is pressed into its closed position, thus onto the valve seat 2, by means of a pressure spring 10. The valve head 1 is in operative connection with a diaphragm 3, which cuts off a first gas chamber 4 in the upper area of the gas flow controller. The three-way valve 9 communicates with three gas pipes, the first gas pipe 7 of which communicates with the first gas chamber 4 above the diaphragm 3. The second gas pipe 6 connects the three-way valve 9 to the second gas chamber 5. The third gas pipe 8 finally connects the three-way valve 9 to the third gas chamber 11.

In the closed position shown, the three-way valve is switched such that the first gas pipe 7 and the second gas pipe 6 communicate with each other. Due to this circuit, there is a pressure difference between the first gas chamber 4 and the second gas chamber 5, which holds the valve head 1 of the main valve in the closed position together with the force of the spring 10.

For opening the main valve, the three-way valve 9 is taken into a position in which it connects the first gas pipe 7 to the third gas pipe 8. This communication serves to relieve the pressure in the first gas chamber 4 towards the third gas chamber 11 and, thus, towards the outlet side of the gas flow controller. Due to the flow resistance upstream of the three-way valve 9, the pressure drops upstream of the three-way valve 9, so that the pressure in the first gas chamber 4 is speedily reduced. Due to the pressure difference produced in this way between the first gas chamber 4 and the second gas chamber 5, the main valve is opened, since the pressure in the second gas chamber 5 becomes higher than the pressure in the first gas chamber 4. Via the diaphragm 3, the valve head 1 is, thus, moved upwards against the force of the spring 10, and it is lifted off the valve seat 2 thereby releasing the opening cross section of the main valve. If the main valve is to be closed again, the three-way valve 9 is simply taken into the position named in the beginning, in which the first gas pipe 7 communicates with the second gas pipe 6. In this way, pressure is again built up in the first gas chamber 4, and the main valve is closed. A suitable intermediate positioning of the three-way valve 9 makes it possible to adjust a certain pressure difference between the first gas chamber 4 and the second gas chamber 5. For this, the inflow of the gas via the second gas pipe 6 and the first gas pipe 7 into the first gas chamber 4 as well as the outflow of the gas via the third gas pipe 8 have to be adjusted accordingly.

The flow cross sections through the gas pipes as well as through the three-way valve 9 are coordinated with the opening and closing behavior of the main valve, just like the flow resistance. To achieve a quick opening and/or closing, large cross sections and low flow resistance are useful. However, the coordination of the cross sections and the flow resistance also may be effected with respect to the desired modulation behavior of the main valve. In one instance, the communication of the first gas chamber 4 with the second gas chamber 5 is coordinated with the opening behavior of the main valve by selecting the cross section and flow resistance of gas lines coupling the first and second gas chambers. These selections can be made, for example, with regard to characteristics of the spring 10 as well as the diaphragm 3 to achieve the desired modulation of the opening cross-section of the main valve.

For general information regarding gas valve control and for specific information regarding an example approach to gas valve control that may be implemented in connection with the present invention, reference may be made to German Patent No. DE 100 26 035 A1, which is fully incorporated herein by reference.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention not be limited with this detailed description.

What is claimed is:

1. A gas flow controller for gas burners comprising:

a main valve being operable by means of a diaphragm that delimits first and second gas chambers; and a three-way valve means connected via gas pipes to the first gas chamber, the second gas chamber in the inlet area of the main valve and a third gas chamber in the outlet area of the main valve, the three-way valve means being operated by an actuator and adapted to control gas flow for applying pressure to the diaphragm for actuating the main valve.

2. A gas flow controller according to claim 1, wherein the three-way valve means is configured and arranged to selectively connect the first gas chamber to either the second gas chamber or the third gas chamber.

3. A gas flow controller according to claim 1, further comprising:

spring means adapted to load the main valve into its closed position.

4. A gas flow controller according to claim 1, wherein the main valve is arranged to be opened when there is a negative pressure in the first gas chamber vis-à-vis the second gas chamber.

5. A gas flow controller according to claim 1, wherein the cross-sectional and flow resistance in gas pipes and through the three-way valve means are configured to achieve at least one of: a selected opening and closing speed of the main valve.

6. A gas flow controller according to claim 1, wherein the cross-sectional and flow resistance in the gas pipes and in the three-way valve means are configured to achieve a modulation of the opening cross section of the main valve.

7. A gas flow controller according to claim 6, wherein the cross-sectional and flow resistance of the gas pipe that connects the three-way valve means to the second gas chamber and the respective inlet area of the three-way valve means are configured to achieve a selected modulation of the opening cross section of the main valve.

8. A gas flow controller according to claim 1, wherein the three-way valve means is a three-way valve.

9. A gas flow controller according to claim 1, wherein the three-way valve means includes a combination of two-way valves.

10. A gas flow controller according to claim 1, wherein the main valve includes a valve head configured and arranged for positioning relative to a valve seat, the main valve being closed when the valve head is in contact with the valve seat and being opened when the valve head is not in contact with the valve seat, and wherein the diaphragm is coupled directly to the valve head and configured and arranged to pull the valve head away from the valve seat, thereby opening the main valve, in response to the pressure in the first gas chamber being less than the pressure in the second gas chamber.

11. A gas flow controller according to claim 3, wherein the diaphragm is configured and arranged to apply additional force to the spring means in a direction away from the main valve in response to the pressure in the first gas chamber being reduced.

12. A gas flow controller comprising:

inlet, outlet and auxiliary chambers;

a main valve coupled between the inlet and outlet chambers and to a diaphragm separating the inlet chamber from the auxiliary chamber, the main valve being controllable in response to movement of the diaphragm; and a three-way control valve coupled to the inlet, outlet and auxiliary chambers and configured and arranged to control movement of the main valve by controlling differential pressure across the diaphragm.

13. The gas flow controller of claim 12, wherein the three-way control valve is adapted to couple the inlet chamber to the auxiliary chamber to reduce a pressure differential across the diaphragm.

14. The gas flow controller of claim 12, wherein the three-way control valve is adapted to couple a relatively higher pressure in the inlet chamber to the auxiliary chamber to increase pressure applied by gas in the auxiliary chamber to the diaphragm and close the main valve.

15. The gas flow controller of claim 12, wherein the three-way control valve is adapted to close a connection between the auxiliary chamber and the inlet chamber to create a pressure differential between the inlet chamber and the auxiliary chamber such that gas pressure on the diaphragm from the inlet chamber opens the main valve.

16. The gas flow controller of claim 12, wherein the three-way control valve is adapted to selectively couple the inlet chamber to the outlet and auxiliary chambers.

17. The gas flow controller of claim 16, wherein the three-way control valve is adapted to couple the inlet chamber to the auxiliary chamber to close the main valve and to couple the inlet chamber to the outlet chamber to open the main valve.

18. A gas flow controller according to claim 12, wherein the main valve includes a valve head and a valve seat, an opening between the inlet and outlet chambers being closeable in response to the valve head contacting the valve seat, further comprising a spring configured and arranged to apply force against the valve head, in a direction towards the valve seat, the diaphragm configured and arranged to apply pressure to counter the force of the spring in direct response to pressure in the inlet chamber.

19. A gas burner supply valve comprising:

first, second and third gas chambers, the first and second gas chambers being separated by a diaphragm, the first and third gas chambers being separated by a main valve coupled to the diaphragm, the main valve being configured and arranged for actuating in response to movement of the diaphragm caused by a differential pressure across the diaphragm; and a three-way servo valve connected via gas pipes to the first, second and third gas chambers and configured and arranged for controlling the differential pressure across the diaphragm to control the actuation of the main valve by selectively coupling the first, second and third gas chambers.

20. A gas burner supply valve according to claim 19 wherein the diaphragm is configured and arranged to open the main valve by deflecting, in response to an increase in pressure on a side of the diaphragm adjacent to the main valve and in direct contact with the first chamber, in a direction away from the side of the diaphragm adjacent to the main valve.

* * * * *